US008545177B2

(12) United States Patent
Dettmann et al.

(10) Patent No.: US 8,545,177 B2
(45) Date of Patent: Oct. 1, 2013

(54) RADIAL COMPRESSOR WITH A DIFFUSER FOR USE IN A TURBOCHARGER

(75) Inventors: Tobias Dettmann, Rüterberg (DE); Andre Kaufmann, Baienfurt (DE); Stefan Krauss, Frankenthal (DE)

(73) Assignee: Continental Automotive GmbH, Hannover (DE)

( * ) Notice: Subject to any disclaimer, the term of this patent is extended or adjusted under 35 U.S.C. 154(b) by 551 days.

(21) Appl. No.: 12/664,948

(22) PCT Filed: Jul. 23, 2008

(86) PCT No.: PCT/EP2008/006053

§ 371 (c)(1),
(2), (4) Date: Dec. 16, 2009

(87) PCT Pub. No.: WO2009/012990

PCT Pub. Date: Jan. 29, 2009

(65) Prior Publication Data

US 2010/0178163 A1 Jul. 15, 2010

(30) Foreign Application Priority Data

Jul. 23, 2007 (DE) ..... 10 2007 034 236

(51) Int. Cl.
*F04D 29/44* (2006.01)

(52) U.S. Cl.
USPC ..... 415/203; 415/212.1; 415/224.5

(58) Field of Classification Search
USPC ..... 415/203, 204, 206, 212.1, 224, 224.5, 415/226, 914
See application file for complete search history.

(56) References Cited

U.S. PATENT DOCUMENTS

| | | | | |
|---|---|---|---|---|
| 2,814,434 | A * | 11/1957 | Boyd | 415/204 |
| 5,310,309 | A | 5/1994 | Terasaki et al. | |
| 5,624,229 | A * | 4/1997 | Kotzur et al. | 415/204 |
| 6,168,375 | B1 * | 1/2001 | LaRue et al. | 415/146 |
| 6,834,501 | B1 | 12/2004 | Vrbas et al. | |
| 2002/0106278 | A1 * | 8/2002 | Koga | 415/211.2 |
| 2005/0232762 | A1 | 10/2005 | Smoke et al. | |

FOREIGN PATENT DOCUMENTS

| | | | |
|---|---|---|---|
| DE | 4106614 | A1 | 9/1992 |
| DE | 19502808 | C2 | 2/1997 |
| EP | 0138480 | A2 | 9/1984 |
| GB | 104966 | A | 3/1917 |
| JP | 60081498 | A | 5/1985 |
| JP | 1173426 | A | 7/1989 |

OTHER PUBLICATIONS

German Office Action dated Feb. 25, 2009.

* cited by examiner

*Primary Examiner* — Edward Look
*Assistant Examiner* — Liam McDowell
(74) *Attorney, Agent, or Firm* — Laurence A. Greenberg; Werner H. Stemer; Ralph E. Locher

(57) ABSTRACT

A radial compressor, in particular for a turbo-charger, has a spiral housing and a diffuser. The diffuser is constructed such that a low-pressure region in the area of the transition between the spiral housing and the tongue is at least reduced.

11 Claims, 3 Drawing Sheets

RADIAL COMPRESSOR WITH A DIFFUSER FOR USE IN A TURBOCHARGER

BACKGROUND OF THE INVENTION

Field of the Invention

The invention relates to a radial compressor with a diffuser, which is used as part of an exhaust gas turbocharger for a motor vehicle, for example.

Turbochargers generally consist of an exhaust gas turbine in an exhaust gas stream, which turbine is connected via a turboshaft to a compressor in the intake channel. In order to achieve this, e.g. a turbine wheel and a compressor wheel are rotatably mounted on the turboshaft, the turbine wheel being arranged in a turbine housing and the compressor wheel in a compressor housing with a diffuser. During operation, the exhaust gas stream which is directed through the turbine housing drives the turbine wheel. The turbine wheel in turn drives the compressor wheel, whereby the compressor increases the pressure in the intake channel of the engine, such that a larger quantity of air enters the cylinder during the intake stroke. Consequently, more oxygen is available and a correspondingly larger quantity of fuel can be burned. The power output of the engine can be increased thereby.

In this context, the compressor has a significant effect on the noise emissions of the turbocharger. In particular, the compressor inlet emits a significant amount of noise externally.

The prior art discloses radial compressors for exhaust gas turbochargers, wherein said radial compressors feature a diffuser which converts the accumulated speed into pressure. Such a diffuser terminates in a so-called spiral, which carries the compressed air to the point of use. The geometry of the transition point of the spiral, i.e. the so-called tongue, is a critical design element in this context, since pressure pulsations often occur at this location. According to the prior art, the problem of the occurrence of such pressure pulsations was previously solved by means of a tongue shape that was advantageous in relation to flow, and a constant diffuser diameter or radius.

In order to reduce the intake noise or in the case of high sound levels, use is frequently made of preconnected sound dampeners. These sound dampeners can feature channel-like or groove-like elements which are lined with sound-absorbing material, for example. In addition to such absorption sound dampeners, it is also possible to install acoustic resonators and acoustic filters for sound dampening.

However, such sound dampeners have the disadvantage that they require additional structural space. Furthermore, the manufacturing and assembly of the sound dampeners is costly and involves considerable effort.

BRIEF SUMMARY OF THE INVENTION

The present invention therefore addresses the problem of providing a compressor with a diffuser which is structured such that the occurrence of pressure pulsations can be reduced at least, or essentially prevented completely.

This problem is solved by a radial compressor having the features described below.

According to the invention, provision is therefore made for a radial compressor, for a turbocharger in particular, comprising:

a spiral housing and a diffuser, wherein the diffuser is designed such that an underpressure zone in the region of the transition point of the spiral housing or the tongue is at least reduced.

In this case, the radial compressor has the advantage that unwanted pressure pulsations can be prevented by virtue of a reduction or suppression of an underpressure zone which occurs primarily at the diffuser in the region of the transition point of the spiral housing. It is therefore possible at least partly, or completely, to forgo the use of additional sound dampeners. This results in a considerable saving in relation to manufacturing and assembly costs. Moreover, it is possible to achieve a more compact construction, e.g. when used in a turbocharger.

According to an inventive embodiment, the cross section of the diffuser is varied such that the development of an underpressure zone is at least reduced or is essentially prevented completely. This has the advantage that the cross section of a diffuser can be adapted or modified relatively easily and is therefore cheaper and does not require any additional structural space in comparison with the use of sound dampeners as per the prior art.

In an inventive embodiment, the cross section of the diffuser is varied in that radius or the diameter of the diffuser is increased in the region of the transition point of the spiral housing or in the region of the tongue. This has the advantage that the diffuser can thereby create a further retardation of the gas speed, and hence a greater pressure build-up. The greater pressure build-up allows a flow that is essentially pulsation-free or at least has reduced pulsation. In this case, the region of the diffuser with the enlarged diameter or radius can be designed in the form of an outward bulge or in the form of an oval.

According to a further inventive embodiment, the cross section of the diffuser is varied in that the width of the diffuser is increased. To this end, the diffuser features a larger or increasing width in the region of the transition point of the spiral housing or in the region of the tongue. The increase in the width of the diffuser results in a comparable effect to the increase of the radius of the diffuser. This likewise prevents or at least reduces the development of an underpressure zone, such that unwanted pulsations and hence the occurrence of corresponding interference noise can be limited.

In a further inventive embodiment, at least one wall or both opposing walls of the diffuser are inclined and/or curved outwards for this purpose. The relevant wall can have a wedge shape in this case, wherein the wedge shape widens outwards. In this case, the walls can be configured identically or differently with regard to their shape, inclination and/or curvature. This has the advantage that, depending on the function and the deployment purpose, the width of the diffuser can be achieved easily in at least one region by adapting both walls or possibly only one wall.

The invention is explained in greater detail below with reference to the exemplary embodiments shown in the schematic figures of the drawings, in which:

DESCRIPTION OF THE INVENTION

In all of the figures, identical or functionally identical elements and devices are denoted by the same reference signs unless otherwise specified.

Figure 1:
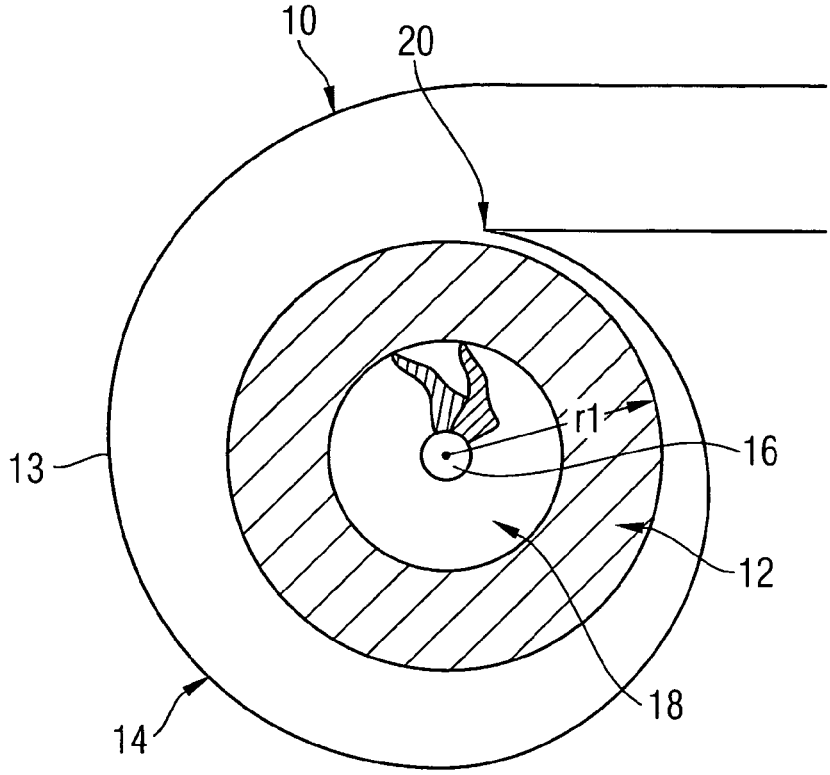
FIG. 1 PRIOR ART
FIG. 1 shows a greatly simplified schematic sectional view of a radial compressor and its diffuser according to the prior art.

FIG. 1 shows a radial compressor 10 with a diffuser 12 as disclosed in the prior art and representing part of a turbocharger (not shown). The radial compressor 10 is shown from the front in a simplified sectional view in this case.

Figure 2:
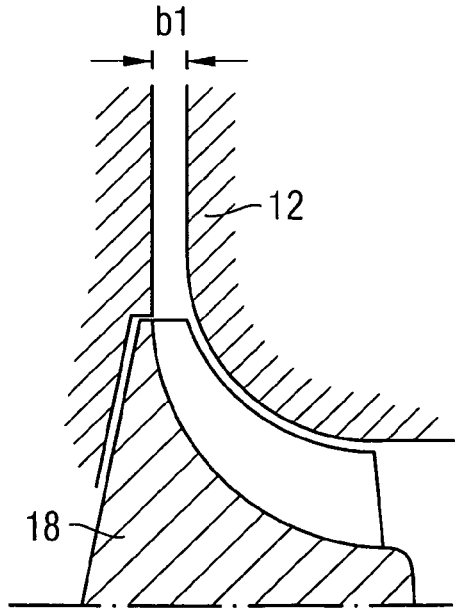
FIG. 2 PRIOR ART
FIG. 2 shows a greatly simplified sectional view through the compressor wheel and a diffuser as per FIG. 1.

In this type of configuration, the radial compressor 10 features a spiral housing 14 and the diffuser 12. The radius r1 or the diameter of the diffuser 12 is constant in this case. Furthermore, the width b1 of the diffuser 12 is constant as shown in FIG. 2. The diffuser 12 therefore has a cross section which is essentially constant.

A turboshaft 16 is arranged in the housing of the radial compressor 10 and a compressor wheel 18 is provided on said turboshaft 16. In this case, the compressor wheel 18 is driven on the turboshaft 16 via a corresponding turbine wheel (not shown). During operation, air is axially inducted by the rotary frequency of the compressor wheel 18, and is accelerated to high speeds in the compressor wheel 18. The air leaves the compressor wheel 18 in a radial direction in this case.

The speed of the air is reduced in the diffuser 12. The consequence of this is an increase in pressure and temperature. The diffuser 12 is formed e.g. of a compressor rear wall and a part of the spiral housing 14. The air is collected in the spiral housing 14, and the speed is further reduced until the compressor outlet. The geometry of the transition point of the spiral 13 of the spiral housing 14, i.e. the so-called tongue 20, represents a critical element of the embodiment in this case, as pressure pulsations often occur at this location because an underpressure zone can form here. As explained above, provision is therefore made inter alia for sound dampeners (not shown) in the radial compressors 10 as per the prior art, in order to prevent or at least reduce unwanted noise caused by such pressure pulsations.

FIG. 2 shows a sectional view through the diffuser 12 and the compressor wheel 18 as per FIG. 1. The width b1 of the diffuser 12 remains essentially constant in this type of configuration.

Figure 3:
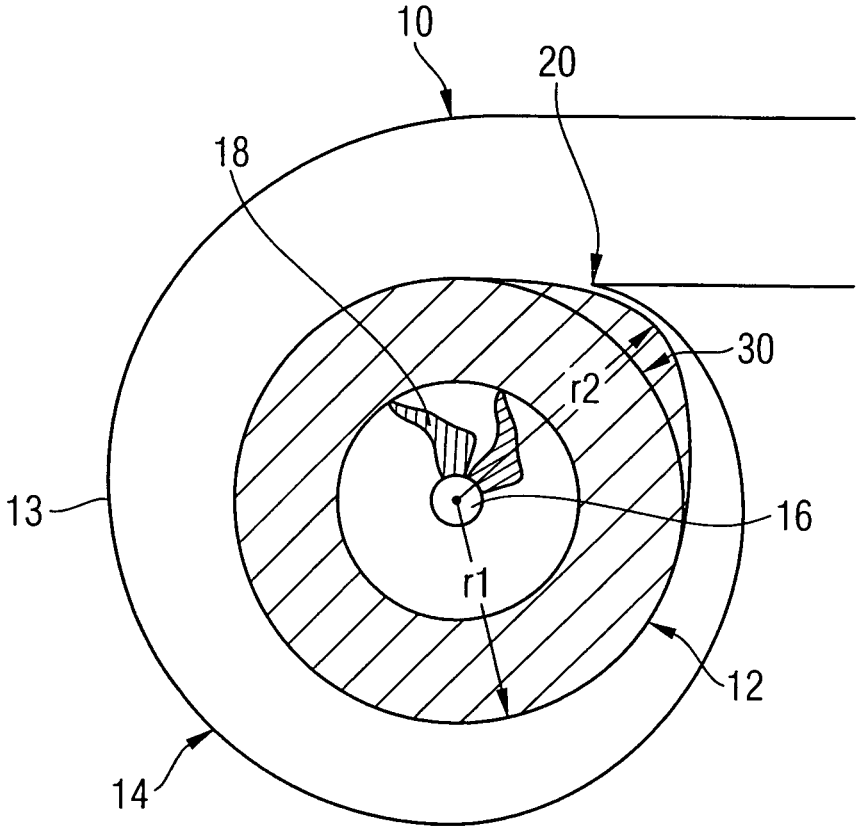
FIG. 3 shows a greatly simplified schematic sectional view of a radial compressor and its diffuser as per a first embodiment of the invention.

Further to this, FIG. 3 now illustrates a radial compressor 10 in accordance with the invention, said radial compressor 10 being part of a turbocharger (not shown). The radial compressor 10 likewise features a spiral housing 14 and a diffuser 12 in this case. As described above in relation to FIG. 1, a compressor wheel 18 and e.g. a turbine wheel (not shown) are arranged on a turboshaft 16. In this type of configuration, the diffuser 12 converts the accumulated speed of the air that is inducted via the compressor wheel 18 into pressure. In this case, the diffuser 12 terminates in the spiral 13 of the spiral housing 14, which carries the compressed air to the point of use.

In order to counteract pressure pulsations which occur in the region of the transition point of the spiral 13, i.e. the so-called tongue 20, the cross section of the diffuser 12 is now modified according to the invention. In other words, the cross section of the diffuser 12 is varied and therefore, unlike the prior art, is not constant. This variation of the cross section can be realized in different ways, as explained in the following.

In order to vary the cross section of the diffuser 12 in a suitable manner, e.g. the radius r or the diameter of the diffuser 12 can be configured or modified as follows. The radius r or the diameter of the diffuser 12 is embodied in such a way that the development of an underpressure zone is reduced or is essentially prevented in the region of the tongue 20, i.e. in the region of the transition point of the spiral. This is achieved e.g. by increasing the radius r or the diameter of the diffuser 12 in at least one predefined region, in order to reduce the development of an underpressure zone or essentially to prevent it completely. A radius r2 of the diffuser in the region of the tongue 20 is therefore selected to be larger than a radius r1 of the diffuser 12 outside of this region.

The inventors have discovered specifically that it is e.g. advantageous, in the case of a diffuser 12 having a constant width, not to use a constant radius r or diameter as was previously the case in the prior art. Instead, it proves to be advantageous if the diffuser 12 is varied in its diameter or radius r. This means that the diffuser 12 has a slightly larger diameter or radius r2 in at least one region, e.g. in a region of the transition point of the spiral 13.

This enlarged diameter or radius r2 of the diffuser 12 produces a further retardation of the gas speed and a greater pressure build-up, thereby allowing a flow that is essentially pulsation-free or at least has reduced pulsation. As a consequence, it is possible to counteract any undesired noise formation, such that it is not necessary to install any additional sound-dampening elements which result in additional costs and assembly effort.

In order to achieve this, as cited above, the diffuser 12 can be configured to have a larger radius r2 or diameter e.g. in the region of the tongue 20 or the transition point of the spiral 13, as shown in FIG. 3. In this case, the diffuser 12 shape extends outwards in the form of a bulge 30 in the region of the tongue 20, for example, or forms an oval in this region. The illustration in FIG. 3 is greatly simplified in this case, and is only intended to clarify the principle of the invention.

Figure 4:
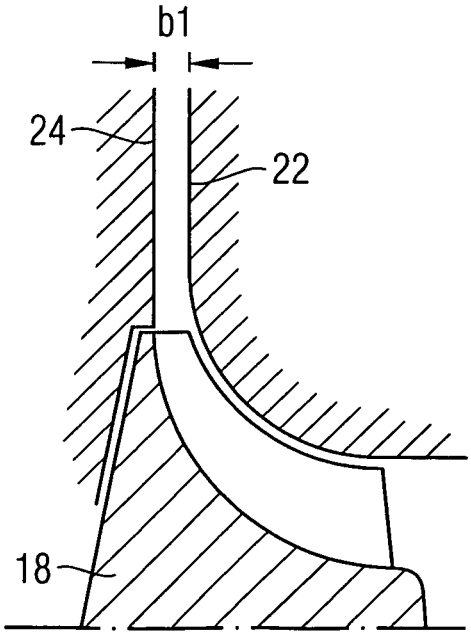
FIG. 4 shows a greatly simplified sectional view through the compressor wheel and a diffuser as per FIG. 3.

Further to this, FIG. 4 shows a sectional view through the compressor wheel 18 and the diffuser 12 as per FIG. 3. The diffuser 12 features an essentially constant width b1 in this case.

Figure 5:
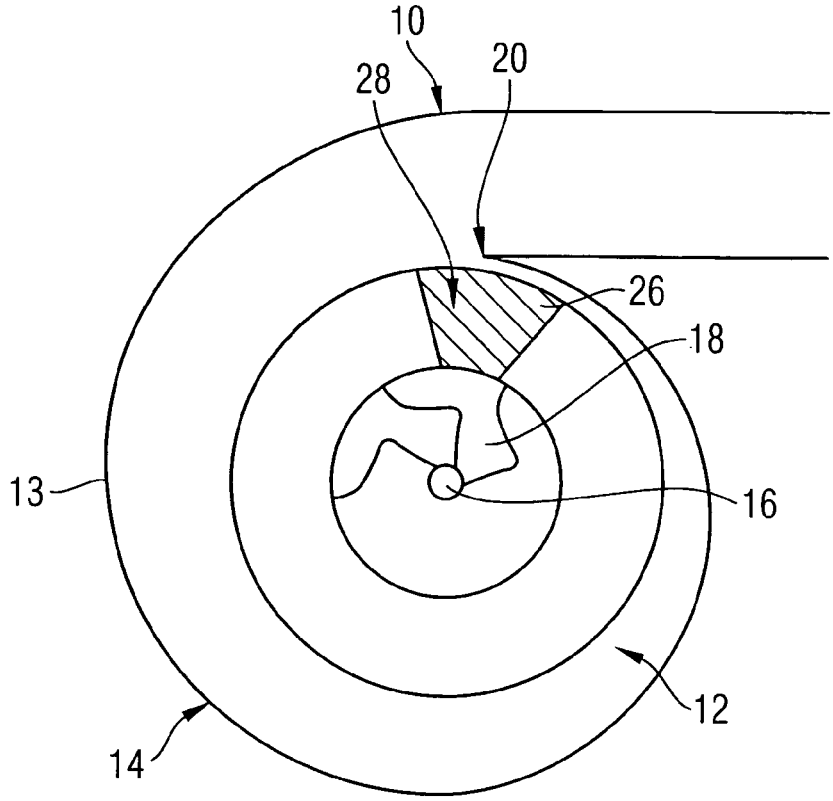
FIG. 5 shows a greatly simplified schematic sectional view of a radial compressor and its diffuser as per a second embodiment of the invention.

Further to this, FIG. 5 shows a second inventive embodiment of the radial compressor 10. The radial compressor 10 features a constant diameter or radius r1 in this case. In order correspondingly to vary the cross section of the diffuser 12, the width b of the diffuser 12 is therefore modified in this case.

Figure 6:
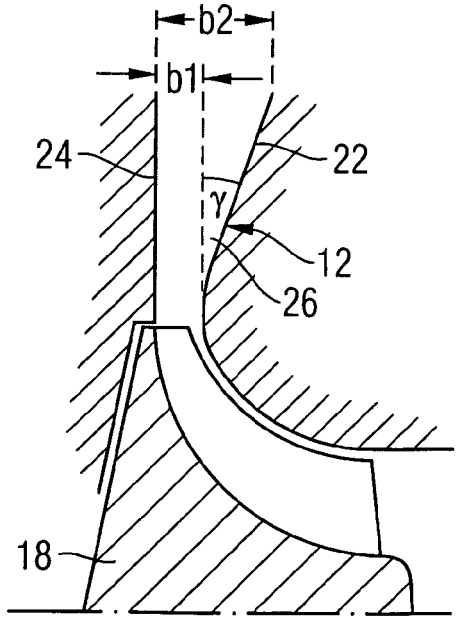
FIG. 6 shows a greatly simplified sectional view through the compressor wheel and a diffuser as per FIG. 5.

According to the invention, the width b of the diffuser 12 is varied in at least one region here, in order to counteract the previously described pressure pulsations which occur e.g. in the region of the transition point of the spiral 13. In this context, the width b of the diffuser 12 is e.g. increased as shown in FIG. 6. The width b1 is increased to a width b2 in the illustrated region in this case. To this end, a first wall 22 of the diffuser 12 is inclined slightly outwards by an angle $\gamma$ in this region. Alternatively, however, the first wall 22 can also be curved, for example. In principle, however, it is also possible for an opposing second wall 24 of the diffuser 12 to be adapted accordingly.

In this context, the width b of the diffuser 12 is varied or increased to a width b2 in the region of the transition point of the spiral 13 or in the region of the tongue 20, for example, in order to counteract the development of an underpressure zone in this region. In this context, the diffuser 12 can feature a type of depression 26 in the form of a wedge 28, as shown in FIG.

5 in a frontal sectional view and in FIG. 6 in a lateral sectional view. In this case, the wedge 28 widens outwards, for example, in the direction of the tongue 20.

Although the present invention is described here with reference to the preferred exemplary embodiments, it is not restricted to said embodiments and can be modified in many and diverse ways. The above described embodiments, and in particular individual features thereof, can be combined in this case.

In this case, for example, at least one region or a plurality of regions of the diffuser 12 can be varied in their diameter or radius r. Furthermore, at least one region or a plurality of regions of the diffuser 12 can be varied in respect of their width b. In this case, the regions are selected e.g. giving consideration to where unwanted pressure pulsations occur, in order to adapt the selected regions such that no underpressure zone occurs or that any underpressure zone is minimized in each case, in order to counteract these pressure pulsations.

Furthermore, a diffuser 12 can also feature at least one region having a varied diameter or radius r in each case, as described in detail above with reference to FIGS. 3 and 4. In addition, this diffuser 12 can optionally feature at least one region whose width b is varied, as explained in detail above with reference to FIGS. 5 and 6. In other words, the cross section of the diffuser 12 can be varied in terms of the diameter or radius r and/or the width b.

Further to this, at least the first and/or second wall 22, 24 of the diffuser 12 can be inclined and/or curved outwards in this context, in order to increase the width b of the diffuser 12. In this case, the two walls 22, 24 can be formed identically or differently, i.e. using different inclinations or curvatures, for example. In this case, the walls 22, 24 can also have different shapes in this region. For example, one wall 22, 24 can be inclined and the other wall 22, 24 curved, depending on the function and deployment.

The invention claimed is:

1. A radial compressor, comprising:

a spiral housing formed with a tongue defining a transition point;

a compressor wheel disposed in said spiral housing;

a diffuser disposed in said spiral housing, said diffuser formed with an opening extending outwardly around said compressor wheel;

said opening having a cross section defined by a given radius and a given width of said diffuser;

wherein said cross-section is varied in at least one manner selected from the group consisting of:

at said tongue and a region adjacent to said tongue, a radius of said diffuser is increased relative to said given radius in a radially outward direction to reduce or prevent formation of an underpressure at said transition point of said tongue, and at said tongue and a region adjacent to said tongue, a width of said diffuser is increased relative to said given width in a radially outward direction to reduce or prevent formation of an underpressure at said transition point of said tongue.

2. The radial compressor according to claim 1, wherein a cross section of said diffuser is varied such that a formation of an underpressure zone is at least reduced or is substantially prevented completely.

3. The radial compressor according to claim 1, wherein said diffuser is formed with a bulge or an oval in a region of said transition point of said spiral housing.

4. The radial compressor according to claim 1, wherein said diffuser has a greater width in a region of said transition point as compared to a width of remaining regions.

5. The radial compressor according to claim 4, wherein said diffuser has at least one wall or mutually opposing walls inclined and/or curved outwards.

6. The radial compressor according to claim 5, wherein said mutually opposing walls are identical in terms of a shape, an inclination, and/or a curvature thereof.

7. The radial compressor according to claim 5, wherein said mutually opposing walls are different in terms of a shape, an inclination, and/or a curvature thereof.

8. The radial compressor according to claim 5, wherein a respective said wall is disposed to form a wedge shape.

9. The radial compressor according to claim 8, wherein the wedge shape is defined to widen outwardly.

10. The radial compressor according to claim 1, wherein:

at said tongue and said region adjacent to said tongue, said radius of said diffuser is increased relative to said given radius in the radially outward direction to reduce or prevent formation of an underpressure at said transition point of said tongue, and at said tongue and said region adjacent to said tongue, said width of said diffuser is increased relative to said given width in the radially outward direction to reduce or prevent formation of an underpressure at said transition point of said tongue.

11. A turbocharger, comprising the radial compressor according to claim 1.

* * * * *